US008112007B2

(12) United States Patent
Sakai et al.

(10) Patent No.: US 8,112,007 B2
(45) Date of Patent: Feb. 7, 2012

(54) IMAGE FORMING APPARATUS, TONE CORRECTION METHOD USING TONE PATCHES AND ALIGNMENT MARKERS, AND COMPUTER-READABLE RECORDING MEDIUM RECORDED WITH A TONE CORRECTION PROGRAM USING TONE PATCHES AND ALIGNMENT MARKERS

(75) Inventors: Tetsuya Sakai, Toyokawa (JP); Soh Hirota, Hoi-gun (JP); Masahiro Kouzaki, Toyohashi (JP); Takashi Harashima, Toyokawa (JP); Kazuomi Sakatani, Toyokawa (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 634 days.

(21) Appl. No.: 12/205,351

(22) Filed: Sep. 5, 2008

(65) Prior Publication Data

US 2009/0067860 A1 Mar. 12, 2009

(30) Foreign Application Priority Data

Sep. 11, 2007 (JP) ..... 2007-235233

(51) Int. Cl.
*G03G 15/00* (2006.01)

(52) U.S. Cl. ..... 399/15; 399/45; 399/72; 399/301

(58) Field of Classification Search ..... 399/15, 399/45, 72, 301
See application file for complete search history.

(56) References Cited

U.S. PATENT DOCUMENTS 5,452,073 A * 9/1995 Kataoka ..... 399/299
6,285,849 B1 * 9/2001 Shimada et al. ..... 399/301
6,408,157 B1 * 6/2002 Tanaka et al. ..... 399/301
6,714,224 B2 * 3/2004 Yamanaka et al. ..... 347/116
6,714,748 B1 * 3/2004 Nakayasu et al. ..... 399/72
6,788,831 B1 * 9/2004 Nabeshima ..... 382/312
7,162,171 B2 * 1/2007 Sugiyama ..... 399/49

(Continued)

FOREIGN PATENT DOCUMENTS

JP 06-311365 11/1994

(Continued)

OTHER PUBLICATIONS

Notification of Reasons for Refusal in JP 2007-235233 dated Jan. 20, 2009, and an English Translation thereof.

*Primary Examiner* — David Gray
*Assistant Examiner* — Francis Gray
(74) *Attorney, Agent, or Firm* — Buchanan Ingersoll & Rooney PC

(57) ABSTRACT

The present invention aims to provide an image forming apparatus and the like that perform a highly-accurate tone correction in a relatively short time and includes the following: a pattern former, with use of each image forming unit, on a sheet, forming tone patches in the main or sub scanning direction (41*k,c,y,m*) and aligning markers, which indicate positions of the tone patches, in the same direction as the tone patches (42*k,c,y,m*); a pattern reader reading the sheet with the tone patches and markers formed thereon; a coordinate determiner determining coordinates of the tone patches in the direction of the aligned tone patches based on the read markers (42*k,c,y,m*); a density determiner determining densities of the tone patches (41*k,c,y,m*) read based on the determined coordinates; and an updating part updating the tone correction table based on relationships between the determined densities and tone levels.

12 Claims, 8 Drawing Sheets

U.S. PATENT DOCUMENTS

| | | | | |
|---|---|---|---|---|
| 7,213,900 | B2 * | 5/2007 | Ebihara | 347/19 |
| 7,431,417 | B2 * | 10/2008 | Rodenas et al. | 347/19 |
| 7,664,407 | B2 * | 2/2010 | Yamanaka et al. | 399/9 |
| 7,769,309 | B2 * | 8/2010 | Tomita et al. | 399/49 |
| 7,853,159 | B2 * | 12/2010 | Yamanaka et al. | 399/13 |
| 7,952,774 | B2 * | 5/2011 | Ikeda | 358/518 |
| 2004/0202489 | A1 * | 10/2004 | Kudou et al. | 399/66 |
| 2005/0158086 | A1 * | 7/2005 | Sato et al. | 399/301 |
| 2006/0222419 | A1 * | 10/2006 | Ishibashi et al. | 399/301 |
| 2006/0227397 | A1 * | 10/2006 | Goma et al. | 358/521 |
| 2008/0043299 | A1 * | 2/2008 | Ikeda | 358/518 |
| 2008/0166140 | A1 * | 7/2008 | Noguchi | 399/15 |

FOREIGN PATENT DOCUMENTS

| | | | |
|---|---|---|---|
| JP | 10-126574 | A | 5/1998 |
| JP | 3648131 | B2 | 5/2005 |
| JP | 2006-349851 | A | 12/2006 |
| JP | 2007-049431 | | 2/2007 |

* cited by examiner

IMAGE FORMING APPARATUS, TONE CORRECTION METHOD USING TONE PATCHES AND ALIGNMENT MARKERS, AND COMPUTER-READABLE RECORDING MEDIUM RECORDED WITH A TONE CORRECTION PROGRAM USING TONE PATCHES AND ALIGNMENT MARKERS

This application is based on application No. 2007-235233 filed in Japan, the content of which is hereby incorporated by reference.

BACKGROUND OF THE INVENTION (1) Field of the Invention

The present invention relates to an image forming apparatus performing both a print function and a scan function, in particular to a technology to correct tone properly. Here, the print function includes forming an image on an, image forming sheet, and the scan function includes reading the image of an original and generating image data.

(2) Description of the Related Art

Conventionally, image forming apparatuses perform an image stabilization process such as a registration correction process or a tone correction process in order to achieve high-quality images. For example, an image forming apparatus (multifunction machine) including a print function and a scan function prints a color shift detection pattern, a tone correction pattern or the like on a sheet of paper, reads the image by scanning the printed paper, and corrects a color shift, tone, and the like in the print function, while taking into consideration uneven rotational periods of an image carrier (Japanese Laid-Open Patent Application Publication No. H10-126574, Japanese Patent Publication No. 3648131, Japanese Laid-Open Patent Application Publication No. 2006-349851).

However, according to the above-mentioned conventional methods, an area of each tone patch in the tone correction pattern needs to be larger than a certain degree, as an inconsistent speed of paper conveyance while printing and scanning the tone correction pattern, a positional shift due to vibration of the apparatus, uneven print and the like need to be taken into account. For example, a conventional tone correction pattern of a four-color image forming apparatus includes a double line of 16 tone patches for each color, which is printed in the main scanning direction of a sheet of A4-sized recording paper. In this way, each recording paper can test 32 tone patches for each color. Accordingly, in order to perform a tone correction with high accuracy, several pages of printing and scanning are required, which is time-consuming and thus undesirable. Also, if the tone correction is to be performed in a relatively short period of time, the number of patterns for the correction will be limited, affecting the accuracy of the tone correction.

Additionally, here, if a toner marker or the like indicating a position of a tone correction pattern is printed at the starting position of the tone correction pattern to improve the positional accuracy, it will not be effective to an overall magnification error and a local magnification error which is caused by an inconsistent speed, vibration of the apparatus, and the like.

In addition, since color shift correction patterns need to be printed as well, a display area on the recording paper will be further limited.

In general, in view of user's convenience, it is preferable that a time required to perform an image stabilization process be short. Thus, it is preferable that tone correction patterns and color shift correction patterns be kept in a sheet of recording paper of a common size such as A4.

SUMMARY OF THE INVENTION

The present invention was conceived in view of the above problems, and aims to provide an image forming apparatus which can perform a highly-accurate tone correction in a relatively short time, a tone correction method for the image forming apparatus, and a computer-readable recording medium recorded with a tone correction program causing the image forming apparatus to perform the tone correction.

In order to achieve the stated aims, the present invention provides an image forming apparatus that performs both a print function and a scan function, the print function including forming an image on an image forming sheet with use of one or more image forming units, and the scan function including generating image data by reading an image of an original, the image forming apparatus comprising: a tone patch storage storing a plurality of tone patches, which are different in tone level, in a one-to-one correspondence with tone levels; a correction table storage storing a tone correction table for correcting relationships between the tone levels and densities of the tone patches; a pattern former operable to, using each of the one or more image forming units, (i) form the tone patches stored in the tone patch storage on the image forming sheet so as to be aligned in one of (a) a main scanning direction and (b) a sub scanning direction, and (ii) form markers, on the image forming sheet, indicating positions of the formed tone patches, the markers being aligned in the aligning direction of the tone patches; a pattern reader operable to read, as the original read using the scan function, the image forming sheet having the tone patches and the markers formed thereon by the pattern former; a coordinate determiner operable to determine, in the direction of the aligned tone patches, coordinates of the tone patches based on the markers read by the pattern reader; a density determiner operable to determine densities of the tone patches read by the pattern reader based on the determined coordinates; and an updating part operable to update the tone correction table stored by the correction table storage based on relationships between the determined densities and the tone levels corresponding to the tone patches which are stored by the tone patch storage.

In order to achieve the stated aims, the present invention also provides a computer readable recording medium having recorded thereon a tone correction program causing an image forming apparatus to execute a tone correction in a print function, the image forming apparatus performing both the print function and a scan function, the print function including forming an image on an image forming sheet with use of one or more image forming units, and the scan function including generating image data by reading an image of an original. Here, the image forming apparatus includes a tone patch storage storing a plurality of tone patches, which are different in tone level, in a one-to-one correspondence with tone levels and a correction table storage storing a tone correction table for correcting relationships between the tone levels and densities of the tone patches, and the tone correction program causes the image forming apparatus to execute processing including a pattern forming step of, using each of the one or more image forming units, (i) forming the tone patches stored in the tone patch storage on the image forming sheet so as to be aligned in one of (a) a main scanning direction and (b) a sub scanning direction, and (ii) forming markers, on the image forming sheet, indicating positions of the formed tone patches, the markers being aligned in the aligning direction of the tone patches, a pattern reading step of reading, as the original read using the scan function, the image forming sheet having the tone patches and the markers formed thereon by the pattern former, a coordinate determining step of determining, in the direction of the aligned tone patches, coordinates of the tone patches based on the markers read by the pattern reader, a density determining step of determining densities of the tone patches read by the pattern reader based on the determined coordinates, and an updating step of updating the tone correction table based on relationships between the determined densities and the tone levels corresponding to the tone patches which are stored by the tone patch storage.

In order to achieve the stated aims, the present invention also provides a tone correction method for correcting a tone correction in a print function, in which the image forming apparatus performs both the print function and a scan function, the print function including forming an image on an image forming sheet with use of one or more image forming units, and the scan function including generating image data by reading an image of an original. Here, the image forming apparatus includes a tone patch storage storing a plurality of tone patches, which are different in tone level, in a one-to-one correspondence with tone levels and a correction table storage storing a tone correction table for correcting relationships between the tone levels and densities of the tone patches, and the tone correction method comprises: a pattern forming step of, using each of the one or more image forming units, (i) forming the tone patches stored in the tone patch storage on the image forming sheet so as to be aligned in one of (a) a main scanning direction and (b) a sub scanning direction, and (ii) forming markers, on the image forming sheet, indicating positions of the formed tone patches, the markers being aligned in the aligning direction of the tone patches; a pattern reading step of reading, as the original read using the scan function, the image forming sheet having the tone patches and the markers formed thereon by the pattern former; a coordinate determining step of determining, in the direction of the aligned tone patches, coordinates of the tone patches based on the markers read by the pattern reader; a density determining step of determining densities of the tone patches read by the pattern reader based on the determined coordinates; and an updating step of updating the tone correction table based on relationships between the determined densities and the tone levels corresponding to the tone patches which are stored by the tone patch storage.

With the stated structure, for a single color or for each of colors, the relationships between the densities of the tone patches and the tone levels can be corrected by determining the coordinates, in the aligning direction, of the tone patches and determining the densities of the tone patches based on the determined coordinates. Consequently, compared to the conventional cases, more tone patches can be generated on a sheet of a limited size, enabling accurate detection of the densities.

As a result, a highly-accurate tone correction can be performed in a relatively short period of time.

The image forming apparatus may be structured in such a manner that the pattern former (i) pre-stores one of (a) data of a pattern composite image that includes a tone correction pattern having the tone patches aligned thereon and a position detection pattern having the markers aligned thereon and (b) a reproduction method of the pattern composite image, and (ii) forms the pattern composite image on the image forming sheet in accordance with one of (a) the data and (b) the reproduction method.

The image forming apparatus caused by the computer readable recording medium having recorded thereon the tone correction program to execute the tone correction may further include a pattern storage pre-storing one of (a) data of a pattern composite image that includes a tone correction pattern having the tone patches aligned thereon and a position detection pattern having the markers aligned thereon and (b) a reproduction method of the pattern composite image, and the pattern former may form the composite image on the image forming sheet in accordance with one of (a) the data and (b) the reproduction method.

The image forming apparatus pertaining to the tone correction method may further include a pattern storage pre-storing one of (a) data of a pattern composite image that includes a tone correction pattern having the tone patches aligned thereon and a position detection pattern having the markers aligned thereon and (b) a reproduction method of the pattern composite image, and the pattern former may form the composite image on the image forming sheet in accordance with one of (a) the data and (b) the reproduction method.

With the stated structure, a predetermined pattern composite image is generated on the image forming sheet, which allows a formation of a test pattern in a short time.

The image forming apparatus may include a plurality of image forming units, each forming an image in a different color. Here, the aligning direction is the sub scanning direction, the aligned markers indicate coordinates, in the sub scanning direction, of the tone patches, the pattern former (i) forms the tone patches and the markers for each color, further (ii) uses the aligned markers also for correcting a color shift in the sub scanning direction, and (iii) if a color formed by a predetermined image forming unit is a reference color, forms a reference color pattern adjacent, in the main scanning direction, to the aligned markers for each color except for the reference color, the reference color pattern being used for correcting the color shift, the pattern reader reads the image forming sheet on which the tone patches, the markers, and the reference color pattern are formed by the pattern former, and the image forming apparatus further comprises a color shift corrector operable to correct the color shift in the sub scanning direction based on the markers and the reference color pattern read by the pattern reader.

The image forming apparatus caused by the computer readable recording medium having recorded thereon the tone correction program to execute the tone correction may include a plurality of image forming units, each forming an image in a different color. Here, the aligning direction is the sub scanning direction, the aligned markers indicate coordinates, in the sub scanning direction, of the tone patches, the pattern forming step includes (i) forming the tone patches and the markers for each color, further includes (ii) using the aligned markers also for correcting a color shift in the sub scanning direction, and (iii) if a color formed by a predetermined image forming unit is a reference color, forming a reference color pattern adjacent, in the main scanning direction, to the aligned markers for each color except for the reference color, the reference color pattern being used for correcting the color shift, the pattern reading step includes reading the image forming sheet on which the tone patches, the markers, and the reference color patterns are formed by the pattern former, and the tone correction program further causes the image forming apparatus to execute a color shift correcting step of correcting the color shift in the sub scanning direction based on the markers and the reference color patterns read by the pattern reader.

The image forming apparatus pertaining to the tone correction method may include a plurality of image forming units, each forming an image in a different color. Here, the aligning direction is the sub scanning direction, the aligned markers indicate coordinates, in the sub scanning direction, of the tone patches, the pattern forming step includes (i) forming the tone patches and the markers for each color, further includes (ii) using the aligned markers also for correcting a color shift in the sub scanning direction, and (iii) if a color formed by a predetermined image forming unit is a reference color, forming a reference color pattern adjacent, in the main scanning direction, to the aligned markers for each color except for the reference color, the reference color pattern being used for correcting the color shift, the pattern reading step includes reading the image forming sheet on which the tone patches, the markers, and the reference color patterns are formed by the pattern former, and the tone correction method further includes a color shift correcting step of correcting the color shift in the sub scanning direction based on the markers and the reference color patterns read by the pattern reader.

With the stated structure, the position detection patterns is also used for correcting a color shift in the sub scanning direction, and thus effectively utilizing the limited size of the sheet.

The image forming apparatus may include a plurality of image forming units, each forming an image in a different color. Here, the aligning direction is the main scanning direction, the aligned markers indicate coordinates, in the main scanning direction, of the tone patches, the pattern former (i) forms the tone patches and the markers for each color, further (ii) uses the aligned markers also for correcting a color shift in the main scanning direction, and (iii) if a color formed by a predetermined image forming unit is a reference color, forms a reference color pattern adjacent, in the sub scanning direction, to the aligned markers for each color except for the reference color, the reference color pattern being used for correcting the color shift, the pattern reader reads the image forming sheet on which the tone patches, the markers, and the reference color pattern are formed by the pattern former, and the image forming apparatus further comprises a color shift corrector operable to correct the color shift in the main scanning direction based on the markers and the reference color pattern read by the pattern reader.

The image forming apparatus caused by the computer readable recording medium having recorded thereon the tone correction program to execute the tone correction may include a plurality of image forming units, each forming an image in a different color. Here, the aligning direction is the main scanning direction, the aligned markers indicate coordinates, in the main scanning direction, of the tone patches, the pattern forming step includes (i) forming the tone patches and the markers for each color, further includes (ii) using the aligned markers also for correcting a color shift in the main scanning direction, and (iii) if a color formed by a predetermined image forming unit is a reference color, forming a reference color pattern adjacent, in the sub scanning direction, to the aligned markers for each color except for the reference color, the reference color pattern being used for correcting the color shift, the pattern reading step includes reading the image forming sheet on which the tone patches, the markers, and the reference color patterns are formed by the pattern former, and the tone correction program further causes the image forming apparatus to execute a color shift correcting step of correcting the color shift in the main scanning direction based on the markers and the reference color patterns read by the pattern reader.

The image forming apparatus pertaining to the tone correction method may include a plurality of image forming units, each forming an image in a different color. Here, the aligning direction is the main scanning direction, the aligned markers indicate coordinates, in the main scanning direction, of the tone patches, the pattern forming step includes (i) forming the tone patches and the markers for each color, further includes (ii) using the aligned markers also for correcting a color shift in the main scanning direction, and (iii) if a color formed by a predetermined image forming unit is a reference color, forming a reference color pattern adjacent, in the sub scanning direction, to the aligned markers for each color except for the reference color, the reference color pattern being used for correcting the color shift, the pattern reading step includes reading the image forming sheet on which the tone patches, the markers, and the reference color patterns are formed by the pattern former. Here, the tone correction method further includes a color shift correcting step of correcting the color shift in the main scanning direction based on the markers and the reference color patterns read by the pattern reader.

With the state structure, a position detection pattern is also used for correcting a color shift in the main scanning direction, and thus effectively utilizing the limited size of the sheet.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF PREFERRED EMBODIMENTS

First Embodiment

<Structure>

Figure 1:
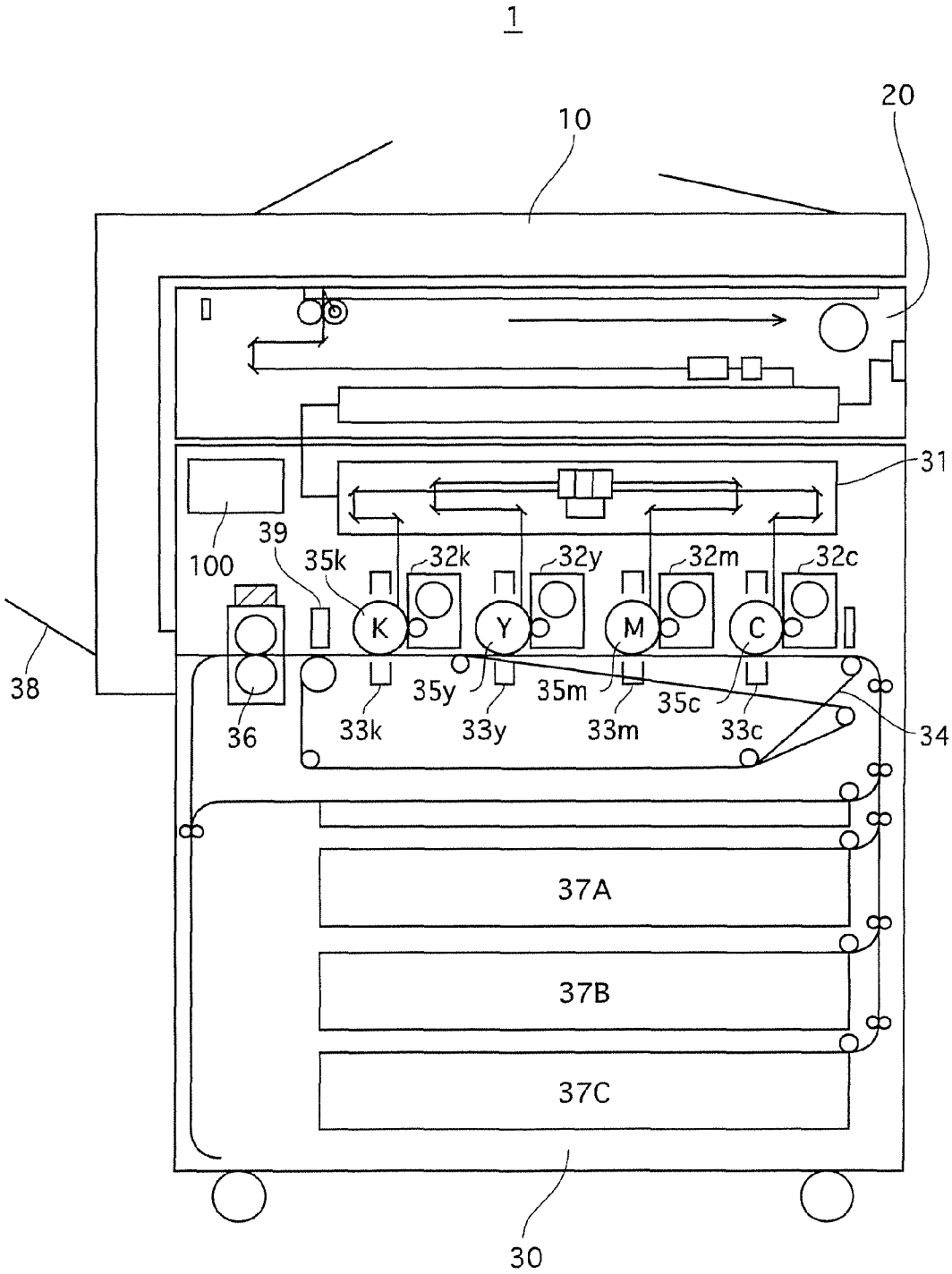
FIG. 1 shows a structure of a multifunction machine (image forming apparatus) in accordance with an embodiment of the present invention.

FIG. 1 shows a structure of a multifunction machine (image forming apparatus) in accordance with an embodiment of the present invention.

As shown in FIG. 1, a multifunction machine 1 of the present embodiment is an MFP (Multiple Function Peripheral) performing versatile functions of multiple apparatuses such as a scanner, a printer, a copier, and a FAX. The multifunction machine 1 performs functions such as (a) a scan function of scanning an original document on a document holder and generating image data, (b) a print function of printing an image based on image data, (c) a copy function of scanning an original document and copying, (d) a FAX function of scanning an original document and transmitting image data thereof, and (e) a memory storage function of storing image data, transmission destination telephone number, and the like, and includes an automatic document feeder (ADF) 10, a scanner 20, an image former 30, and a controller 100.

The automatic document feeder 10 automatically conveys multiple documents placed on a document tray by a user to a scanning position in a sequential order for the scanner 20 to perform scanning.

It should be noted that when an image stabilization process is performed, the automatic document feeder 10 can further automatically convey a sheet of recording paper with a pattern composite image printed thereon by the image former 30 to the scanning position for the scanner 20 to scan the pattern composite image. Also, the image stabilization process is performed at a predetermined timing, for example, immediately after power is turned on, after a predetermined count of prints are made, or after a predetermined time has passed.

The scanner 20 mainly performs document reading in the scan, function and copy function. The scanner 20 scans documents automatically conveyed by the automatic document feeder or placed on the document holder by the user and generate image data. The generated image data is (a) transmitted to the image former 30 to be printed when the copy function is performed, (b) facsimiled when the FAX function is performed, (c) transmitted to an external apparatus such as a PC or a storage device to be stored when the memory storage function is performed, and (d) transmitted to the controller 100 to be data-processed when the image stabilization process is performed. Note that the data-processing by the controller 100 will be described later.

The image former 30 mainly performs image forming in the print function and copy function. The image former 30 forms an image on the recording paper based on image data such as those received from the scanner 20 or an external apparatus or those received by FAX, and outputs the formed image. The image former 30 includes the following: an exposing device 31; developing devices 32*k*, 32*y*, 32*m*, and 32*c*; transfer chargers 33*k*, 33*y*, 33*m*, and 33*c*; a transfer belt 34; photoconductors 35*k*, 35*y*, 35*m*, and 35*c*; a fixing device 36; paper feeding cassettes 37A to 37C; a paper ejector 38; and a reflective photosensor 39. It should be noted that in the image former 30, an image forming unit that mainly includes structural elements denoted by numerical references with a suffix "k" forms an image using black toner. Likewise, an image forming unit mainly including structural elements denoted by numerical references with a suffix "y" forms an image using yellow toner, an image forming mainly including structural elements denoted by numerical references with a suffix "m" forms an image using magenta toner, and an image forming mainly including structural elements denoted by numerical references with a suffix "c" forms an image using cyan toner.

Here, the multifunction machine 1 forms an image with an appropriate image density and tone by sequentially performing the following steps: (a) forming toner patterns of various image forming conditions for each color on the transfer belt 34 or a sheet of recording paper, (b) detecting an amount of toner by applying light using the reflective photosensor 39 and measuring an amount of reflected light, and (c) controlling image forming conditions for each color such as a charging voltage, developing bias, and light exposure, in the operating process, based on the detected amount of toner.

Also, in a normal image formation process, under the control of the controller 100, (a) the exposing device 31 forms an electrostatic latent image on each of the photoconductors 35*k*, 35*y*, 35*m*, and 35*c*, (b) the developing devices 32*k*, 32*y*, 32*m*, and 32*c* generate toner patterns by developing the formed electrostatic latent image, (c) the transfer chargers 33*k*, 33*y*, 33*m*, and 33*c* transfer the generated toner patterns onto a recording sheet which is fed by one of the paper feeding cassettes 37A to 37C and is electrostatically adsorbed to the transfer belt 34, and (d) the fixing device 36 fixes the toner pattern on the recording sheet. After the above process, the recording sheet is ejected to the paper ejector 38.

Additionally, in the image stabilization process, under the control of the controller 100, (a) the exposing device 31 forms an electrostatic latent image of a pattern composite image on the photoconductors 35*k*, 35*y*, 35*m*, and 35*c*, (b) the developing devices 32*k*, 32*y*, 32*m*, and 32*c* generate toner patterns by developing the formed electrostatic latent image of the pattern composite image, (c) the transfer chargers 33*k*, 33*y*, 33*m*, and 33*c* transfer the generated toner patterns of the pattern composite image onto a sheet of recording paper which is fed by one of the paper feeding cassettes 37A to 37C and is electrostatically adsorbed to the transfer belt 34, (d) the fixing device 36 fixes the toner pattern of the pattern composite image on the recording paper, and after that, (e) the recording paper with the pattern composite image printed thereon is placed on the scanning position, for example, manually by the user or a service person, (f) the scanner 20 scans the pattern composite image, and (g) the controller 100 analyzes data of the pattern composite image scanned by the scanner 20.

The controller 100 which includes a CPU, a memory and the like realizes each function by monitoring signals from each sensor and controlling overall operation timings of the automatic document feeder 10, scanner 20, image former 30 and the like. The controller 100 (1) stores, for use in the print function, multiple tone patches, each of which is unique in tone level, in association with respective tone levels and (2) retains a tone correction table (two-dimensional look-up table) which corrects relationships between tone levels and read densities of the tone patches formed on an image forming sheet for image formation. The tone correction table indicates correction values for properly correcting the relationships between densities and tone steps in the print function. In the normal image formation, this tone correction table is used to correct tones, and in the image stabilization process, the tone correction table is updated.

Figure 2:
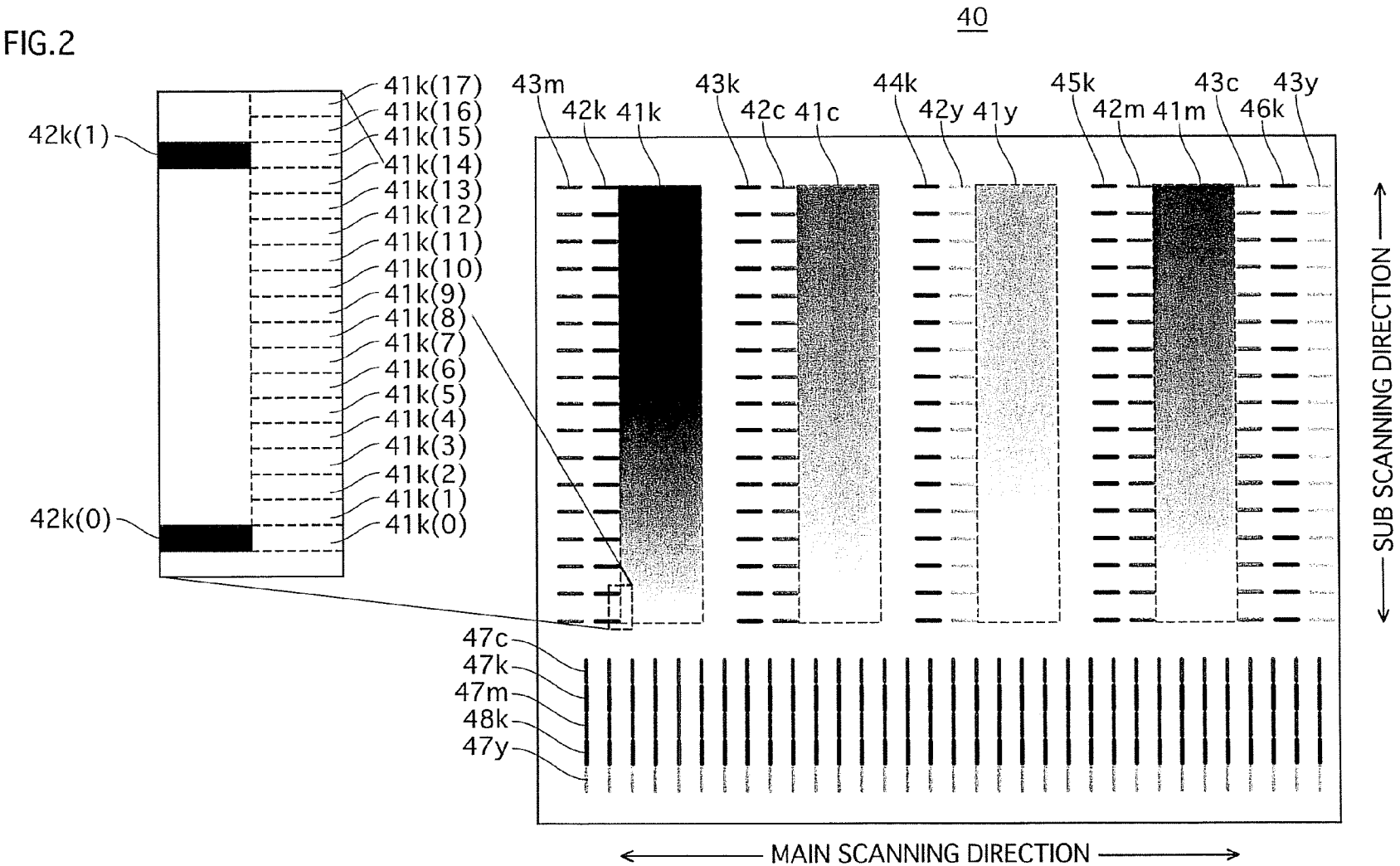
FIG. 2 is an example of a pattern composite image generated by an image former 30.

FIG. 2 is an example of a pattern composite image generated by an image former 30.

As shown in FIG. 2, a pattern composite image 40 includes the following patterns formed by the respective above-mentioned image formation units: tone correction patterns 41*k*, 41*y*, 41*m*, and 41*c*; position detection patterns 42*k*, 42*y*, 42*m*, and 42*c*; first color shift correction patterns 43*k*, 43*y*, 43*m*, 43*c*, 44*k*, 45*k*, and 46*k*; and second color shift correction patterns 47*c*, 47*k*, 47*m*, 48*k*, and 47*y*. Here, in the pattern composite image 40, a pattern denoted by a numerical reference with a suffix "k" is generated by the image forming unit for black. Likewise, a pattern denoted by a numerical reference with a suffix "y" is generated by the image forming unit for yellow, a pattern denoted by a numerical reference with a suffix "m" is generated by the image forming unit for magenta, and a pattern denoted by a numerical reference with a suffix "c" is generated by the image forming unit for cyan.

The tone correction patterns 41*k*, 41*y*, 41*m*, and 41*c* each include multiple kinds of tone patches aligned along a sub scanning direction, which is a rotating direction of the photoconductors 35*k*, 35*y*, 35*m*, and 35*c* and moving direction of the recording paper. The tone correction patterns 41*k*, 41*y*, 41*m*, and 41*c* are used to update the tone correction table in the image stabilization process, and, in the present embodiment, include 256 tone patches corresponding to tone levels from 0 to 255, respectively, and being aligned in a sequential order of the tone levels in the sub scanning direction. The size of a tone patch for one tone is 16-dot wide in the sub scanning direction and 256-dot long in the main scanning direction. For example, if the print density is 600 dpi, the diameter of 1 dot is approximately 42.3 μm.

The position detection patterns 42*k*, 42*y*, 42*m*, and 42*c* each include an alignment of straight line-shaped toner markers placed adjacent, in the main scanning direction, to each tone correction pattern. The toner markers have their longitudinal direction lying in the main scanning direction and indicate positions, in the aligning direction, of multiple tone patches in the tone correction patterns 41*k*, 41*y*, 41*m*, and 41*c* printed by the corresponding image forming units, respectively. In the image stabilization process, the position detection patterns 42*k*, 42*y*, 42*m*, and 42*c* are used to specify coordinates, in the main scanning direction, of the respective tone correction patterns. In the present embodiment, one toner marker is formed for every 16 tones of tone patches for each image forming unit. Specifically, each position detection pattern includes 17 toner markers which are adjacent to the tone patches corresponding to tone levels 0, 15, 31, 47, 63, 79, 95, 111, 127, 143, 159, 175, 191, 207, 223, 239, and 255, respectively. These position detection patterns are also used for correcting color shifts in the sub scanning direction.

Here, in order to explain positional relationships between the tone correction patterns and the position detection patterns, the upper left of FIG. 2 provides an enlarged view of a portion where the tone correction pattern 41*k* and the position detection pattern 42*k* are adjacent to each other.

As shown in the enlarged view, in the tone correction pattern 41*k*, a tone patch 41*k*(0) corresponding to the tone level 0 is generated in an area which begins at the bottom end thereof, the area being 16-dot wide in the sub scanning direction and 256-dot long in the main scanning direction. Also, in an area, which is of the same size as the tone patch 41*k*(0), located immediately above the tone patch 41*k*(0), a tone patch 41*k*(1) corresponding to the tone level 1 is generated, and a tone patch 41*k*(2) corresponding to the tone level 2 is generated immediately above the tone patch 41*k*(1). In this way, a tone patch which is higher by one in tone level than a tone patch corresponding to a low tone level is generated immediately above the tone patch corresponding to the low tone level, and 256 tone patches are aligned in a sequential order of the tone levels up to the tone level 255, to which a tone patch 41*k*(255) corresponds (in the enlarged view, tone patches up to a tone patch 41*k*(17) are shown; tone patches 41*k*(18) to (255) are not shown). Also, a toner marker 42*k*(0) of the position detection pattern 42*k* is adjacent, in the left lateral direction, to the tone patch 41*k*(0), and there are no toner markers adjacent, in the left lateral direction, to the following 14 tone patches 41*k*(1) to (14). Similarly, a toner marker 42*k*(1) of the position detection pattern 42*k* is adjacent, in the left lateral direction, to the tone patch 41*k*(15); there are no toner markers adjacent, in the left lateral direction, to the following 15 tone patches from the tone patch 41*k*(16); and there is a toner marker adjacent, in the left lateral direction, to the 16th tone patch from the tone patch 41*k*(16). Likewise, up to a toner marker 42*k*(16), one toner marker is formed for every 16 tone patches which correspond to 16 tone levels. Accordingly, the 17 toner markers in total comprise the position detection pattern 42*k* (in the enlarged view, the toner markers up to 42*k*(1) are shown, and the toner markers 42*k*(2) to (16) are not shown).

It should be noted that specific descriptions on the following positional relationships are omitted as these are the same as the positional relationship between the tone correction pattern 41*k* and the position detection pattern 42*k*: the positional relationships between (1) the tone correction pattern 41*c* and the position detection pattern 42*c*, (2) the tone correction pattern 41*m* and the position detection pattern 42*m*, and (3) the tone correction pattern 41*y* and the position detection pattern 42*y*.

The first color shift correction patterns 43*k*, 43*y*, 43*m*, 43*c*, 44*k*, 45*k*, and 46*k* include, as with the position detection patterns 42*k*, 42*y*, 42*m*, and 42*c*, toner markers lined up in the sub scanning direction. Particularly, the first color shift correction patterns 43*k*, 44*k*, 45*k* each are formed adjacent, in the main scanning direction, to the tone correction patterns 41*y*, 41*m*, and 41*c* for the colors other than black, the color used as a reference color for color shift correction, namely, yellow, magenta, and cyan. Color shifts in the sub scanning direction are corrected, in an extensive range in the sub scanning direction, based on shift amounts of the adjacent two kinds of patterns, the first color shift correction patterns and the tone correction patterns. Also, the first color shift correction pattern 43*m* is formed adjacent to the tone correction pattern 42*k* for black, the reference color, and is used to correct color shifts of magenta subsidiarily. The first color shift correction pattern 43*m* further corrects positional shifts of skew elements of magenta based on its shift amount from the position detection pattern 42*m*. Additionally, the first color shift correction patterns 43*c*, 46*k*, and 43*y* are formed in positions where black, the reference color, is in the center with cyan and yellow on its both sides. These are used subsidiarily to correct cyan and yellow in a similar way to magenta and to correct positional shifts of skew elements of cyan and yellow based on their shift amounts from the position detection patterns 42*c* and 42*y*.

The second color shift correction patterns 47*c*, 47*k*, 47*m*, 48*k*, and 47*y* are each composed of an alignment, in the main scanning direction, of straight line-shaped toner markers, a longitudinal direction thereof lying in the sub scanning direction. The patterns for yellow, magenta, and cyan are placed so as to adjoin one of the patterns for black, the reference color, and correct color shifts in the main scanning direction for each color in an extensive range in the main scanning direction.

<First Operation>

Figure 3:
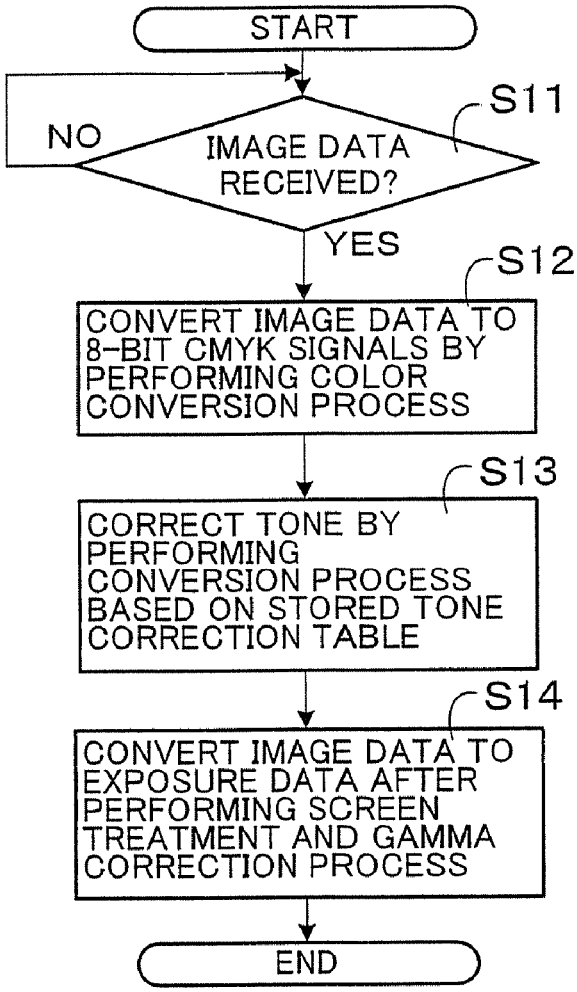
FIG. 3 shows an outline of data processing in an image formation.

FIG. 3 shows an outline of data processing in an image formation.

In the following, a data-processing procedure of an image formation performed by the controller 100 is described along the flow in FIG. 3.

(1) The controller 100 waits for a reception of image data (step S11).

(2) Upon receiving image data, the controller 100 converts the image data, to 8-bit CMYK signals by performing a color conversion process (step S12).

(3) The controller 100 corrects tone by performing a conversion process based on a stored tone correction table (step S13).

(4) The image data is converted into exposure data after a screen treatment and gamma correction are performed (step S14).

Following the above, the exposure data generated by the controller 100 are used by the exposing device 31 to control a semiconductor laser, exposing the photoconductors 35*k*, 35*y*, 35*m*, and 35*c*.

Here, the tone correction is performed to always maintain a stable tone characteristic by compensating for variance of sensitivity characteristic or development characteristic of the photoconductor due to variation in a manufacturing process of the multifunction machine 1, environmental conditions, or a secular change. The tone correction table is referred to during the tone correction and is updated based on actual measurement values during the image stabilization process.

<Second Operation>

Figure 4:
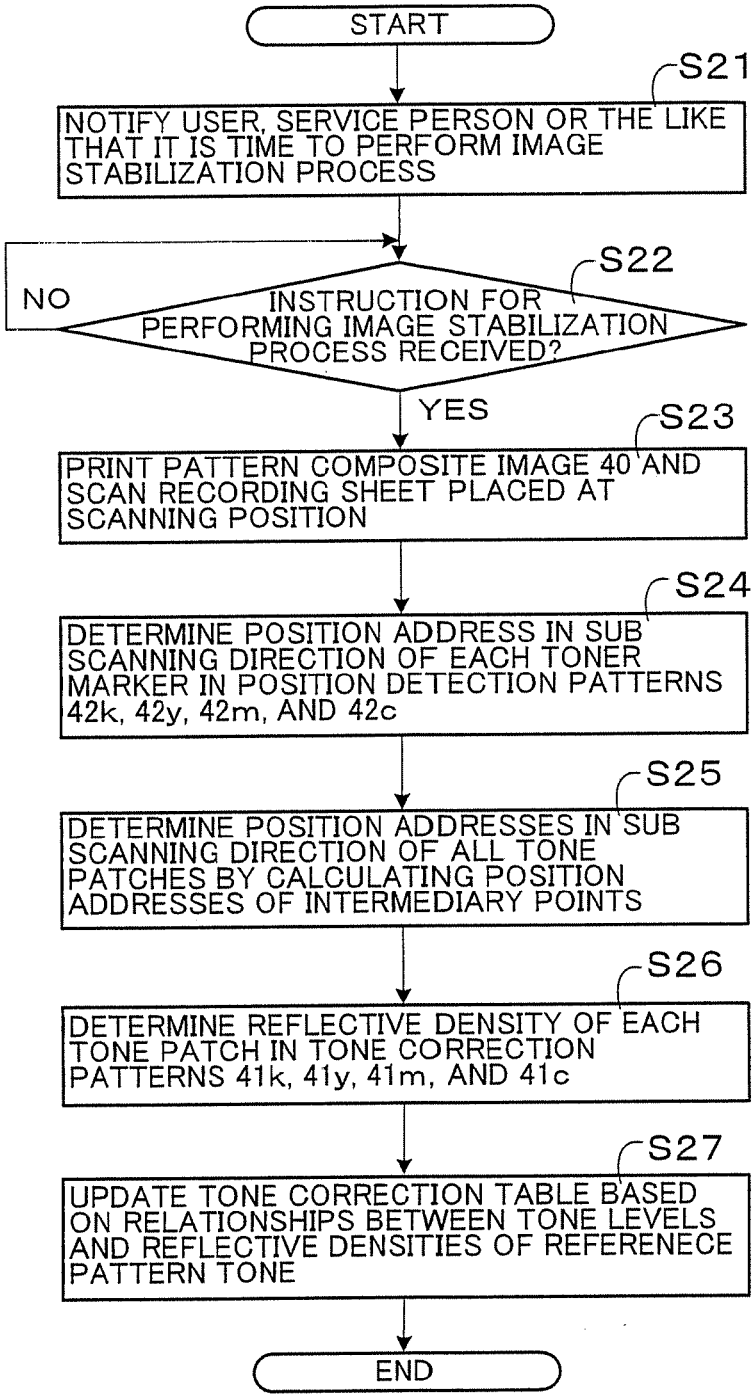
FIG. 4 shows an outline of operations in an image stabilization process.

FIG. 4 shows an outline of operations in an image stabilization process.

In the following, an outline of the image stabilization process operation is described along the flow in FIG. 4.

(1) When a criterion for performing the image forming process is met such as when a predetermined number of prints are produced or when a predetermined time has passed, the controller 100 notifies such as the user or service person accordingly by a display on a display device such as a liquid crystal panel (step S21).

(2) The controller 100 waits for an execution instruction of the image stabilization process from, for example, the user or service person (step S22).

(3) Upon receiving an execution instruction of the image stabilization process, the image former 30 prints the pattern composite image 40 shown in FIG. 2. Then, (a) the recording paper with the pattern composite image printed thereon is placed at the scanning position, for example, manually by the user or serviceman who instructed the execution of the image stabilization process, and (b) the scanner 20 reads the pattern composite image 40 by scanning the recording paper placed at the scanning position (step S23).

(4) When analyzing data of the scanned pattern composite image, the controller 100 determines a position address, in the sub scanning direction, of each toner marker by analyzing a density distribution in the sub scanning direction at the position detection patterns 42*k*, 42*y*, 42*m*, and 42*c* (step S24).

The determined position address in the sub scanning direction corresponds, when the main scanning direction of the scanned pattern composite image is assumed to be an x-axis and the sub scanning direction of the same is assumed to be a y-axis, to a value of the y-axis and indicates a relative address of a memory in which the data of the pattern composite image is stored.

Figure 5:
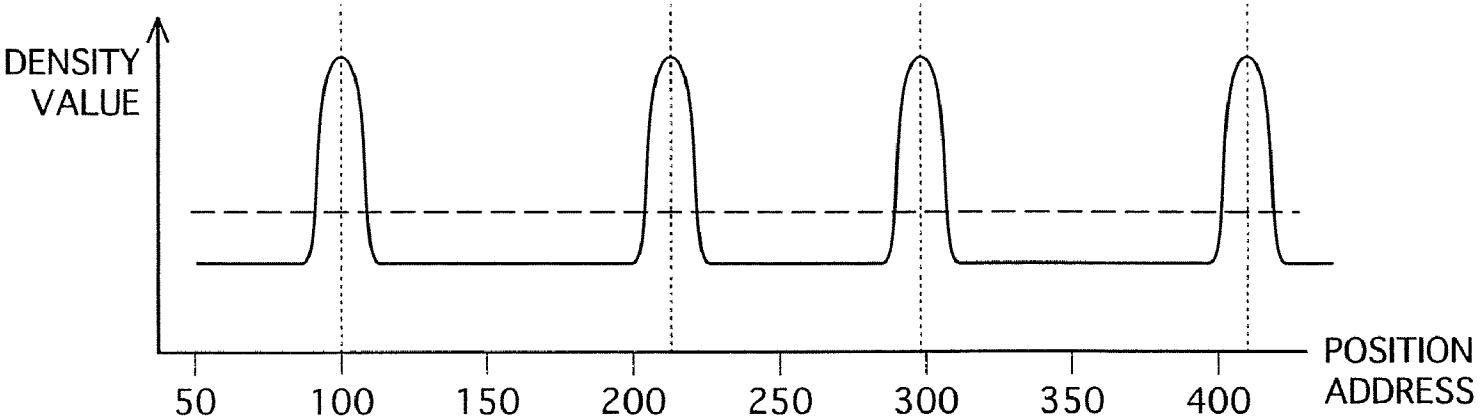
FIG. 5 shows a portion of density distribution in a sub scanning direction with an x-axis indicating a position address in the sub scanning direction and y-axis indicating a density value of a position detection pattern.

FIG. 5 shows a portion of density distribution in a sub scanning direction with an x-axis indicating a position address in the sub scanning direction and y-axis indicating a density value of a position detection pattern.

Here, the peak of the density value in an area above a threshold (a dotted line in the figure) is identified as the position address of each toner marker in the sub scanning direction.

In the present embodiment, the position addresses of 17 toner markers are determined in the sub scanning direction.

(5) Position addresses, in the sub scanning direction, of all the tone patches are determined by calculating position addresses of intermediary points using such as a first-order approximation in accordance with each determined position address for each position detection pattern. Here, the determined position addresses are used as position addresses of reference pattern tones (step S25).

In the present embodiment, intermediary points are calculated using the position addresses of 17 tone patches at the tone levels of 0, 15, 31, 47, 63, 79, 95, 111, 127, 143, 159, 175, 191, 207, 223, 239, and 255. The calculated intermediary points include 14 between the tone levels 0 and 15, and 15 each between the following 15 pairs of tone levels: 15 and 31, 31 and 47, 47 and 63, 63 and 79, 79 and 95, 95 and 111, 111 and 127, 127 and 143, 143 and 159, 159 and 175, 175 and 191, 191 and 207, 207 and 223, 223, and 239, and 239 and 255. These calculated intermediary points and the original 17 provide a total number of 256 calculated position addresses.

For example, when the position addresses of the tone levels 255 and 239 are "100" and "210", respectively, position addresses of intermediary points determined with first-order approximation between the tone levels 255 and 239 are as follows. For the tone level 254, the position address is "107", which is the rounded result of "100+1/16×(210−100) =106.875"; for the tone level 253, the position address is "114", the rounded result of "100+2/16×(210−100) =113.75"; for the tone level 252, the position address is "121", the rounded result of "100+3/16×(210−100) =120.625"; for the tone level 251, the position address is "128", the rounded result of "100+4/16×(210−100)=127.5"; for the tone level 250, the position address is "134, the rounded result of "100+5/16×(210−100)=134.375"; for the tone level 249, the position address is "141", the rounded result of "100+6/16×(210−100)=141.25"; for the tone level 248, the position address is "148", the rounded result of "100+7/16×(210−100)=148.125"; for the tone level 247, the position address is "155", the rounded result of "100+8/16×(210−100)=155"; for the tone level 246, the position address is "162", the rounded result of "100+9/16×(210−100) =161.875"; for the tone level 245, the position address is "169", the rounded result of "100+10/16×(210−100) =168.75"; for the tone level 244, the position address is "176", the rounded result of "100+11/16×(210−100) =175.625"; for the tone level 243, the position address is "183", the rounded result of "100+12/16×(210−100) =182.5"; for the tone level 242, the position address is "189", the rounded result of "100+13/16×(210−100)=189.375"; for the tone level 241, the position address is "196", the rounded result of "100+14/16×(210−100)=196.25"; and for the tone level 240, the position address is "203", the rounded result of "100+15/16×(210−100)=203.125". Likewise, position addresses of intermediary points for the tone levels below 238 are calculated.

(6) For all the calculated position addresses in the sub scanning direction, a reflective density of each tone patch in the respective tone correction patterns 41*k*, 41*y*, 41*m*, and 41*c* is determined by extracting a corresponding portion of data from the pattern composite image data scanned by the scanner 20 (step S26) and performing computation based on the extracted data. Note that a fixed value is used for the position address in the main scanning direction here. It should also be noted here that the length of each tone patch in the main scanning direction is considerably longer than its width in the sub scanning direction, and in the main scanning direction, a position address in vicinity of the center is used. In this way, even with positional shifts due to such as speed variance in conveying sheets or vibration of the apparatus and positional deviations due to print irregularities and the like taken into consideration, the position address in the main scanning direction will remain within the area of the tone patch. Therefore, the position address in the main scanning direction does not need to be calculated.

Figure 6:
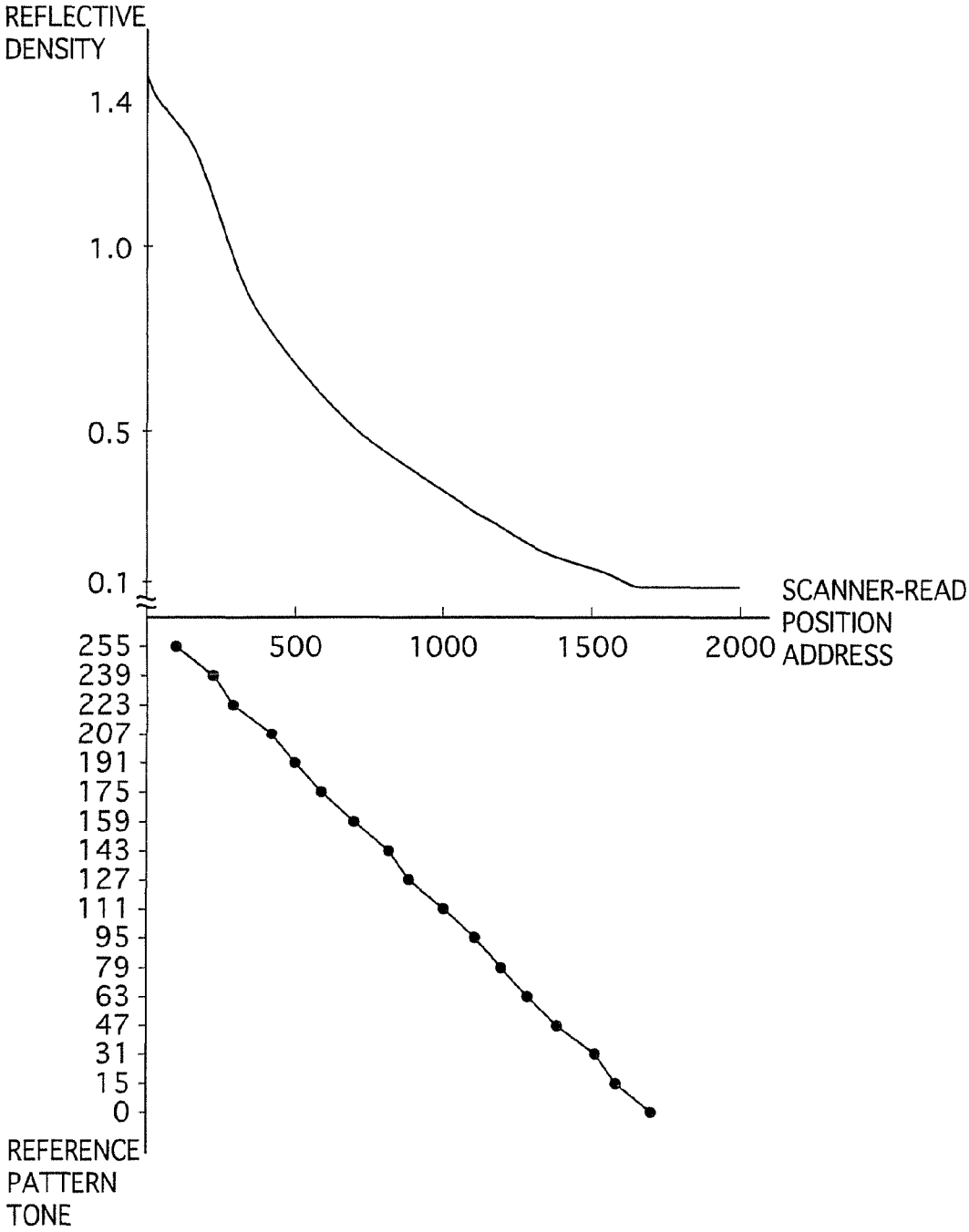
FIG. 6 shows, in a data analysis of a scanned pattern composite image, relationships between reference pattern tones and position addresses in the sub scanning direction obtained from measurement values in position detection patterns and calculation of intermediary points (lower figure) and relationships between the position addresses in the sub scanning direction and reflective densities in a tone correction pattern obtained from measurement values in the tone correction pattern (upper figure)

FIG. 6 shows, in a data analysis of a scanned pattern composite image, relationships between reference pattern tones and position addresses in the sub scanning direction obtained from measurement values in position detection patterns and calculation of intermediary points (lower figure) and relationships between the position addresses in the sub scanning direction and reflective densities in a tone correction pattern obtained from measurement values in the tone correction pattern (upper figure).

From the lower figure in FIG. 6, the position address in the sub scanning direction corresponding to each reference pattern tone can be determined. After that, a reflective density corresponding to the position address determined using the lower figure can be obtained from the upper figure in FIG. 6, allowing to obtain accurate reflective densities for all the reference pattern tones.

(7) The stored tone correction table is updated based on relationships between the reflective densities of all the reference pattern tones determined for respective tone patches and the tone levels corresponding to the respective tone patches so that the relationships between the densities and tone steps can be corrected more properly in the print function (step S27).

Figure 7:
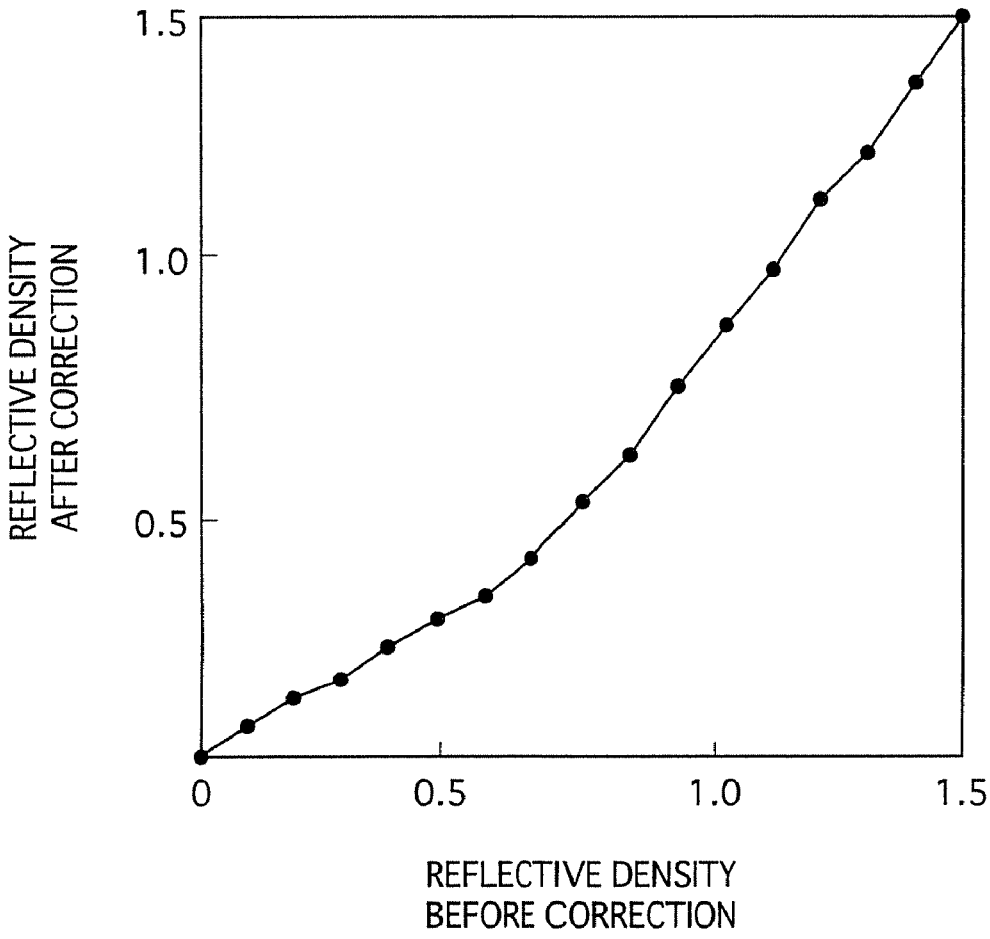
FIG. 7 shows one of tone correction tables for each color.

FIG. 7 shows one of tone correction tables for each color.

As shown in FIG. 7, the tone correction table shows relationships between reflective densities before correction and reflective densities after correction, enabling specification of corrected reflective density values for respective reflective density values for each color of the received image data. This allows appropriate corrections of the relationships between the densities and the tone steps in the image formation.

Here, the reflective density before the correction indicates an intended reflective density of the corresponding tone level formed in the image formation. The reflective density after the correction is correlated to the reflective density obtained by scanning the image of the formed tone by a scanner, and corresponds to the tone level associated with the tone patch which should be used in the image formation.

Note that the updated tone correction table will be used from the next image formation.

(8) Next, color shifts in the sub scanning direction are corrected. In this process, as with the position detection patterns 42*k*, 42*y*, 42*m*, and 42*c* in the step S24, a position address in the sub scanning direction is determined for each toner marker of the first color shift correction patterns 43*k*, 43*y*, 43*m*, 43*c*, 44*k*, 45*k*, and 46*k* (step S28).

(9) By using the position addresses, in the sub scanning direction, of the position detection patterns 42*k*, 42*y*, 42*m*, and 42*c* determined in the step S24 and the position addresses of the first color shift correction patterns 43*k*, 43*y*, 43*m*, 43*c*, 44*k*, 45*k*, and 46*k* determined in the step S28 together, with the black patterns as references, shift amounts from the reference color are determined based on differences between the black patterns and the patterns for the three colors, each of which is adjacent to one of the black patterns. Based on the determined shift amounts, a print start timing, scanning start position, and scanning cycle in the image formation are corrected so as to decrease the shift amounts in the sub scanning direction (step S29).

(10) Subsequently, color shifts in the main scanning direction are corrected. In this step, as with the position detection patterns 42*k*, 42*y*, 42*m*, and 42*c* in the step S24, a position address in the main scanning direction is determined for each toner marker of the second color shift correction patterns 47*c*, 47*k*, 47*m*, 48*k*, and 47*y* (step S30).

(11) With the black patterns as references, shift amounts from the reference color are determined based on differences between the black patterns and the patterns for the three colors which are adjacent to the black patterns. As in the color shift correction in the sub scanning direction, based on the determined shift amounts, a print start timing, scanning start position, and scanning cycle in the image formation are corrected so as to decrease the shift amounts in the main scanning direction (step S31).

(12) Also, by using the position addresses in the sub scanning direction of the position detection patterns 42*k*, 42*y*, 42*m*, and 42*c* determined in the step S24 and those of the first color shift correction patterns 43*k*, 43*y*, 43*m*, 43*c*, 44*k*, 45*k*, and 46*k* determined in the step S28, a print start timing, scanning start position, and scanning cycle in the image formation are corrected so as to decrease positional shifts of skew elements (step S32). Note that the first color shift correction patterns can be generated in more than 3 places in the main scanning direction to decrease positional shifts of bow elements.

[First Modification]

While, in the pattern composite image shown in FIG. 2, the tone patches are aligned in the sub scanning direction, they can be aligned in the main scanning direction instead.

Figure 8:
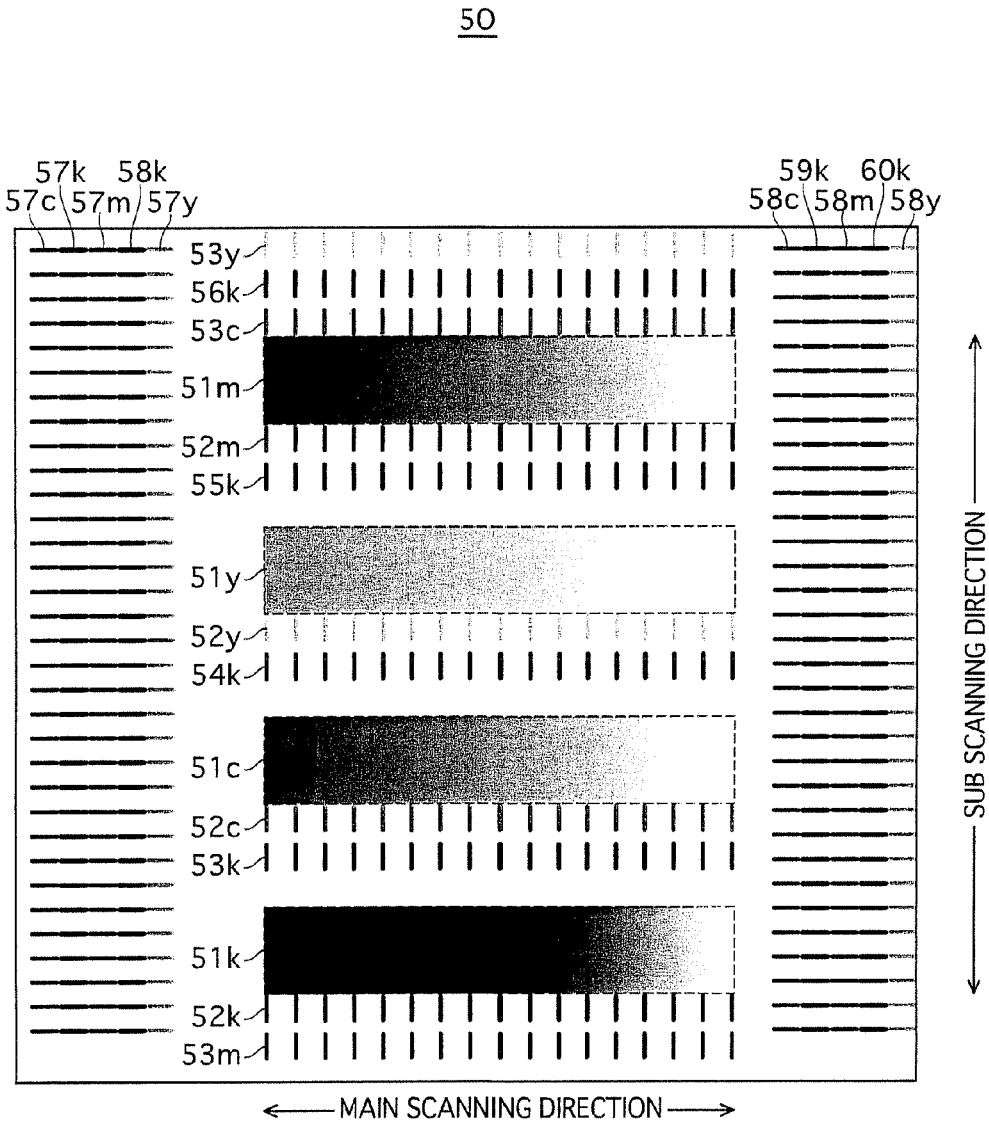
FIG. 8 is another example of a pattern composite image generated by the image former 30.

FIG. 8 is another example of a pattern composite image generated by the image former 30.

As shown in FIG. 8, a pattern composite image 50 includes the following patterns formed by the corresponding above-mentioned image forming units: tone correction patterns 51*k*, 51*y*, 51*m*, and 51*c*; position detection patterns 52*k*, 52*y*, 52*m*, and 52*c*; first color shift correction patterns 53*k*, 53*y*, 53*m*, 53*c*, 54*k*, 55*k*, and 56*k*; second color shift correction patterns 57*c*, 57*k*, 57*m*, 58*k*, 57*y*, 58*c*, 59*k*, 58*m*, 60*k*, and 58*y*. In the pattern composite image 50, a pattern denoted by a numerical reference with a suffix "k" is generated by the image forming unit for black. Likewise, a pattern denoted by a numerical reference with a suffix "y" is generated by the image forming unit for yellow, a pattern denoted by a numerical reference with a suffix "m" is generated by the image forming unit for magenta, and a pattern denoted by a numerical reference with a suffix "c" is generated by the image forming unit for cyan.

The main scanning direction and sub scanning direction of the tone correction patterns 51*k*, 51*y*, 51*m*, and 51*c* each are opposite in direction with those of the tone correction patterns 41*k*, 41*y*, 41*m*, and 41*c*; the main scanning direction and sub scanning direction of the position detection patterns 52*k*, 52*y*, 52*m*, and 52*c* each are opposite in direction with those of the position detection patterns 42*k*, 42*y*, 42*m*, and 42*c*; the main scanning direction and sub scanning direction of the second color shift correction patterns 57*c*, 57*k*, 57*m*, 58*k*, and 57*y* each are opposite in direction with those of the second color shift correction patterns 47*c*, 47*k*, 47*m*, 48*k*, and 47*y*; and the second color shift correction patterns 58*c*, 59*k*, 58*m*, 60*k*, and 58*y* each are, as with the second color shift correction patterns 57*c*, 57*k*, 57*m*, 58*k*, and 57*y*, used for correcting positional shifts of skew elements.

An image stabilization process using the pattern composite image 50 can be performed, just as using the pattern composite image 40, by only interchanging the main scanning direction and sub scanning direction. However, correcting positional shifts of skew elements needs to be performed based on shift amounts between each of the second color shift correction patterns 57*c*, 57*k*, 57*m*, 58*k*, and 57*y* and second color shift correction patterns 58*c*, 59*k*, 58*m*, 60*k*, and 58*y*.

It should be noted that while a tone correction pattern of the present embodiment includes tone patches corresponding to all the reproducible tone levels, not all the tone steps need to be included. Thus, for example, the tone correction pattern can include one tone patch for every 2 or 3 tone steps. Also, since highlighted portions are considered to be most important in image reproduction, for instance, tone steps of highlight can be provided in high density while tone steps of medium to high intensity can be provided in low density. This enables a highly accurate tone correction in a relatively short period of time.

Additionally, resolution of the tone correction table can be changed based on an image position, according to a level of necessity for tone correction and characteristics of each apparatus. For instance, by dividing an image into multiple areas and using a tone correction table with high resolution for areas at and around the center, which require a high-resolution tone correction, and using a tone correction table with low resolution for other areas, a time required for data conversion process in the image formation can be shortened.

In addition, while in the present embodiment, a pattern composite image is formed on a sheet of recording paper, it is not limited to this, and can be any sheet-like material for image formation as long as an image can be formed thereon.

Also, in the present embodiment, data of a pattern composite image is pre-stored, and in the image stabilization process, the pre-stored pattern composite image data is used as it is to form the image. However, other methods can be applied instead of storing the data itself, as long as a pattern composite image can be reproduced. For example, a reproduction method of a pattern composite image can be pre-stored to perform an image formation by reproducing the pattern composite image based on the pre-stored method.

Further, while a color MFP is described as an example in the present embodiment, it is not limited to this, and for instance, it can be monochrome, and can be any apparatus as long as it is equipped with a print function and a scan function.

<Summary>

As described above, according to the embodiment of the present invention, coordinates, in the aligning direction, of respective tone patches are determined based on position detection patterns located adjacent to multiple tone patches for each color, and relationships between densities and tone steps in a print function can be corrected by determining densities of the respective tone patches based on the above-determined coordinates. Consequently, compared to conventional cases, more tone patches can be generated on limited size of paper thereby to accurately detect densities, achieving a highly-accurate tone correction in a relatively short period of time.

In addition, since the position detection patterns are also used for color shift correction, limited size of paper can be effectively utilized.

Also, a program, which can cause a computer to execute any one or more operations described in the above-described first embodiment and first modification may be recorded on a computer-readable recording medium, and the recording medium may be an object of distribution or business. The program itself also may be an object of distribution or business, for example, via a network, and may be displayed on a display apparatus, printed, or provided to users.

The computer-readable recording medium mentioned here may be removable recording medium such as a floppy disk, a CD, an MO, a DVD, or a memory card, or a fixed recording medium such as a hard disk or semiconductor memory.

INDUSTRIAL APPLICABILITY

The present invention can be widely applied to a technology field of an image forming apparatus such as an MFP.

The present invention enables a highly-accurate tone correction in a relatively short period of time, and thus the industrial applicability thereof is extremely high, as it enhances user's convenience and provides an image forming apparatus forming high-quality images.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus that performs both a print function and a scan function, the print function including forming an image on an image forming sheet with use of one or more image forming units, and the scan function including generating image data by reading an image of an original, the image forming apparatus comprising:

a tone patch storage storing a plurality of tone patches, which are different in tone level, in a one-to-one correspondence with tone levels;

a correction table storage storing a tone correction table for correcting relationships between the tone levels and densities of the tone patches;

a pattern former operable to, using each of the one or more image forming units, (i) form the tone patches stored in the tone patch storage on the image forming sheet so as to be aligned in one of (a) a main scanning direction and (b) a sub scanning direction, and (ii) form markers, on the image forming sheet, indicating positions of the formed tone patches, the markers being aligned in the aligning direction of the tone patches;

a pattern reader operable to read, as the original is read using the scan function, the image forming sheet having the tone patches and the aligned markers formed thereon by the pattern former;

a coordinate determiner operable to determine, in the direction of the aligned tone patches, coordinates of the tone patches based on the aligned markers read by the pattern reader;

a density determiner operable to determine densities of the tone patches read by the pattern reader based on the determined coordinates; and an updating part operable to update the tone correction table stored by the correction table storage based on relationships between the determined densities and the tone levels corresponding to the tone patches which are stored by the tone patch storage.

2. The image forming apparatus of claim 1, wherein the pattern former (i) pre-stores one of (a) data of a pattern composite image that includes a tone correction pattern having the tone patches aligned thereon and a position detection pattern having the markers aligned thereon and (b) a reproduction method of the pattern composite image, and (ii) forms the pattern composite image on the image forming sheet in accordance with one of (a) the data and (b) the reproduction method.

3. The image forming apparatus of claim 1 further comprises a plurality of image forming units, each forming an image in a different color, wherein the aligning direction is the sub scanning direction, the aligned markers indicate coordinates, in the sub scanning direction, of the tone patches, the pattern former forms the tone patches and the aligned markers for each color, if a color formed by a predetermined image forming unit is a reference color, the pattern former forms a reference color pattern adjacent, in the main scanning direction, to the aligned markers for each color except for the reference color, the reference color pattern being used for correcting the color shift, the pattern reader reads the image forming sheet on which the tone patches, the aligned markers, and the reference color pattern are formed by the pattern former, and the image forming apparatus further comprising a color shift corrector operable to correct the color shift in the sub scanning direction based on the aligned markers and the reference color pattern read by the pattern reader.

4. The image forming apparatus of claim 1 further comprises a plurality of image forming units, each forming an image in a different color, wherein the aligning direction is the main scanning direction, the aligned markers indicate coordinates, in the main scanning direction, of the tone patches, the pattern former forms the tone patches and the aligned markers for each color, if a color formed by a predetermined image forming unit is a reference color, the pattern former forms a reference color pattern adjacent, in the sub scanning direction, to the aligned markers for each color except for the reference color, the reference color pattern being used for correcting the color shift, the pattern reader reads the image forming sheet on which the tone patches, the aligned markers, and the reference color pattern are formed by the pattern former, and the image forming apparatus further comprising a color shift corrector operable to correct the color shift in the main scanning direction based on the aligned markers and the reference color pattern read by the pattern reader.

5. A nontransitory computer readable recording medium having recorded thereon a tone correction program causing an image forming apparatus to execute a tone correction in a print function, the image forming apparatus performing both the print function and a scan function, the print function including forming an image on an image forming sheet with use of one or more image forming units, and the scan function including generating image data by reading an image of an original, wherein the tone correction program causes the image forming apparatus to execute processing comprising:

a pattern forming step of using each of the one or more image forming units, (i) forming a plurality of tone patches, which tone patches are different in tone level, in a one-to-one correspondence with tone levels, and which plurality of tone patches are stored in a tone patch storage of the image forming apparatus, the plurality of tone patches being formed on the image forming sheet so as to be aligned in one of (a) a main scanning direction and (b) a sub scanning direction, and (ii) forming markers, on the image forming sheet, indicating positions of the formed tone patches, the markers being aligned, in the aligning direction of the tone patches;

a pattern reading step of reading, as the original is read using the scan function, the image forming sheet having the tone patches and the markers formed thereon by the pattern forming step;

a coordinate determining step of determining, in a direction of the aligned tone patches, coordinates of the tone patches based on the markers read by the pattern reading step;

a density determining step of determining densities of the tone patches read by the pattern reading step based on the determined coordinates; and an updating step of updating a tone correction table in the image forming apparatus, the tone correction table for correcting relationships between the tone levels and densities of the tone patches, the updating based on relationships between the determined densities and the tone levels corresponding to the tone patches which are stored by the tone patch storage.

6. The nontransitory computer readable recording medium of claim 5, wherein the pattern forming step forms the composite image on the image forming sheet in accordance with one of (a) data of a pattern composite image that includes a tone correction pattern having the tone patches aligned thereon and a position detection pattern having the markers aligned thereon and (b) a reproduction method of the pattern composite image stored on the image forming apparatus.

7. The nontransitory computer readable recording medium of claim 5, wherein the image is formed with a plurality of image forming units, each forming an image in a different color, the aligning direction is the sub scanning direction, the aligned markers indicate coordinates, in the sub scanning direction, of the tone patches, the pattern forming step includes (i) forming the tone patches and the markers for each color, further includes (ii) using the aligned markers also for correcting a color shift in the sub scanning direction, and (iii) if a color formed by a predetermined image forming unit is a reference color, forming a reference color pattern adjacent, in the main scanning direction, to the aligned markers for each color except for the reference color, the reference color pattern being used for correcting the color shift, the pattern reading step includes reading the image forming sheet on which the tone patches, the markers, and the reference color patterns are formed by the pattern former, and the tone correction program further causes the image forming apparatus to execute a color shift correcting step of correcting the color shift in the sub scanning direction based on the markers and the reference color patterns read by the pattern reader.

8. The nontransitory computer readable recording medium of claim 5, wherein the image is formed with a plurality of image forming units, each forming an image in a different color, the aligning direction is the main scanning direction, the aligned markers indicate coordinates, in the main scanning direction, of the tone patches, the pattern forming step includes (i) forming the tone patches and the markers for each color, further includes (ii) using the aligned markers also for correcting a color shift in the main scanning direction, and (iii) if a color formed by a predetermined image forming unit is a reference color, forming a reference color pattern adjacent, in the sub scanning direction, to the aligned markers for each color except for the reference color, the reference color pattern being used for correcting the color shift, the pattern reading step includes reading the image forming sheet on which the tone patches, the markers, and the reference color patterns are formed by the pattern former, and the tone correction program further causes the image forming apparatus to execute a color shift correcting step of correcting the color shift in the main scanning direction based on the markers and the reference color patterns read by the pattern reader.

9. A tone correction method for correcting a tone correction in a print function, in which an image forming apparatus performs both the print function and a scan function, the print function including forming an image on an image forming sheet with use of one or more image forming units, and the scan function including generating image data by reading an image of an original, wherein the tone correction method comprises:

a pattern forming step of using each of the one or more image forming units, (i) forming a plurality of tone patches, which tone patches are different in tone level, in a one-to-one correspondence with tone levels, and which plurality of tone patches are stored in a tone patch storage of the image forming apparatus, the plurality of tone patches being formed on the image forming sheet so as to be aligned in one of (a) a main scanning direction and (b) a sub scanning direction, and (ii) forming markers, on the image forming sheet, indicating positions of the formed tone patches, the markers being aligned, in the aligning direction of the tone patches;

a pattern reading step of reading, as the original is read using the scan function, the image forming sheet having the tone patches and the markers formed thereon by the pattern forming step;

a coordinate determining step of determining, in a direction of the aligned tone patches, coordinates of the tone patches based on the markers read by the pattern reading step;

a density determining step of determining densities of the tone patches read by the pattern reading step based on the determined coordinates; and an updating step of updating a tone correction table in the image forming apparatus, the tone correction table for correcting relationships between the tone levels and densities of the tone patches, the updating based on relationships between the determined densities and the tone levels corresponding to the tone patches which are stored by the tone patch storage.

10. The tone correction method of claim 9, wherein the pattern forming step forms the composite image on the image forming sheet in accordance with one of (a) data of a pattern composite image that includes a tone correction pattern having the tone patches aligned thereon and a position detection pattern having the markers aligned thereon and (b) a reproduction method of the pattern composite image stored on the image forming apparatus.

11. The tone correction method of claim 9, wherein the image is formed with a plurality of image forming units, each forming an image in a different color, the aligning direction is the sub scanning direction, the aligned markers indicate coordinates, in the sub scanning direction, of the tone patches, the pattern forming step includes (i) forming the tone patches and the markers for each color, further includes (ii) using the aligned markers also for correcting a color shift in the sub scanning direction, and (iii) if a color formed by a predetermined image forming unit is a reference color, forming a reference color pattern adjacent, in the main scanning direction, to the aligned markers for each color except for the reference color, the reference color pattern being used for correcting the color shift, the pattern reading step includes reading the image forming sheet on which the tone patches, the markers, and the reference color patterns are formed by the pattern former, and the tone correction method further includes a color shift correcting step of correcting the color shift in the sub scanning direction based on the markers and the reference color patterns read by the pattern reader.

12. The tone correction method of claim 9, wherein the image is formed with a plurality of image forming units, each forming an image in a different color, the aligning direction is the main scanning direction, the aligned markers indicate coordinates, in the main scanning direction, of the tone patches, the pattern forming step includes (i) forming the tone patches and the markers for each color, further includes (ii) using the aligned markers also for correcting a color shift in the main scanning direction, and (iii) if a color formed by a predetermined image forming unit is a reference color, forming a reference color pattern adjacent, in the sub scanning direction, to the aligned markers for each color except for the reference color, the reference color pattern being used for correcting the color shift, the pattern reading step includes reading the image forming sheet on which the tone patches, the markers, and the reference color patterns are formed by the pattern former, and the tone correction method further includes a color shift correcting step of correcting the color shift in the main scanning direction based on the markers and the reference color patterns read by the pattern reader.

* * * * *